United States Patent [19]

Scheiner

[11] 3,978,532

[45] Sept. 7, 1976

[54] CRIB INCLUDING REFLECTIVE SURFACE

[76] Inventor: Gloria Scheiner, 81 Meadowbrook Road, Randolph, N.J. 07801

[22] Filed: Feb. 23, 1976

[21] Appl. No.: 660,483

[52] U.S. Cl. ..... 5/93 R; 5/11

[51] Int. Cl.[2] ..... A47D 7/00; A47C 31/00

[58] Field of Search ..... 5/11, 93–100; D6/14–17; 312/234

[56] References Cited

UNITED STATES PATENTS

| | | | |
|---|---|---|---|
| 1,836 | 1/1836 | Key | 5/131 |
| 1,265,157 | 5/1918 | Zofsak | 5/93 R |
| 1,341,106 | 5/1920 | Booth | 312/225 |
| 2,553,862 | 5/1961 | Morris | D6/15 |
| 3,383,718 | 5/1968 | Spencer | 5/11 X |

*Primary Examiner*—Paul R. Gilliam
*Assistant Examiner*—P. Caun
*Attorney, Agent, or Firm*—Lerner, David, Littenberg & Samuel

[57] ABSTRACT

An infant's crib including means for occupying a child therein is disclosed. Specifically, the crib includes a pair of end members and a pair of side members, and at least one of the end members is composed of a reflective, preferably non-breakable, material. In another embodiment, such a reflective material is attached or laminated to the surface of a conventional wooden end member, on the inside surface thereof.

8 Claims, 2 Drawing Figures

CRIB INCLUDING REFLECTIVE SURFACE

FIELD OF THE INVENTION

The present invention is directed to infant cribs. More particularly, the present invention is specifically directed to infant cribs including at least one end member. Still more particularly, the present invention is directed to infant cribs including a pair of end members comprising a head board and a foot board, and side members connecting same.

BACKGROUND OF THE INVENTION

Infant cribs and the like have been manufactured for many years, and surprisingly, the nature of these cribs has not drastically changed over a long period of time. Basically, these cribs have included at least one end member, such as a headboard and/or a footboard, and side members generally including spaced railings therefor. A mattress and the like is mounted therein, forming a complete enclosure for the infant, for both sleeping purposes and to act as a playpen, and the like, for the infant.

In addition, several variations of such cribs and/or playpens have been developed for accomplishing additional purposes, such as environmental control, and the like. For example, U.S. Pat. No. 3,878,570 to Donnelly discloses such a crib which includes a flexible canopy to enclose substantially the entire crib area. This canopy is basically intended in order to filter heat and humidify the air breathed by the infant, and also for safety purposes. In addition, U.S. Pat. No. 2,566,737 to Merdian shows the use of a translucent fabric or plastic material so that the infant can be observed through that material when he is inside the crib. This crib also includes a shield for protecting the infant from drafts and the like comprising a flexible covering of fabric, etc.

Several modifications to cribs and playpens have been developed in order to entertain or amuse the infant while he is therein. For example, U.S. Pat. No. 3,344,442 to Andrews et al discloses a crib cover for attachment to the top of such crib formed from a transparent plastic bubble. This patentee also discloses that this bubble is receptive to manuscript inscriptions by marking crayons, and the like, for the purpose of entertaining the child, etc. In addition, it is disclosed that the bubble may have applied thereto dyes and/or pigments to impart coloration to the bubble while retaining its transparency. Furthermore, U.S. Pat. No. 3,165,759 to O'Daniell discloses an inflatable amusement device for use in playpens comprising a suitable rigid material such as wood, plastic, or metal, and an upper inflatable, flexible, and resilient member thereon. Furthermore, U.S. Pat. No. 2,883,678 to Heffernan et al discloses a crip canopy which is again attached to the upper portion of the crib, and which can include ornamental or decorative designs on the underside thereof to attract the attention of the child and to occupy the mind and provide interesting entertainment therefor.

Finally, it is also known to employ various toys, mirrors, and other devices in conjunction with cribs, that is separated therefrom, in order to entertain or amuse the infant therein. None of these devices, however, have achieved such results, nor particularly have they done so in a simple, expedient manner whereby additional devices or complex apparatus are now required separate and apart from the crib itself.

It is therefore an object of the present invention to overcome each of the deficiencies of these prior art methods and apparatus, and furthermore to provide a new and improved crib structure which itself accomplishes these results.

It is yet another object of the present invention to provide an infant's crib which in an efficient and safe manner enables an infant to observe its own image while in the crib. It is yet another object of the present invention to thereby expand the child's environment, and to promote a positive self-image for the child, inspiring independent play, security, etc. In this manner, not only is the child maintained in a secure and content manner, but in this manner the child does not immediately require attention from its parents.

SUMMARY OF THE INVENTION

In accordance with the present invention, these and other objects have been accomplished by providing a crib which includes a pair of opposing end members and a pair of opposing side members attached to each of those end members, so that the side and end members form an enclosure, and in particular where at least one of those end members comprises a reflective face so that an infant within that enclosure can observe his own image thereupon. In particular, it is preferred that such end member actually be manufactured from such a reflective material. In another embodiment, however, it is also contemplated that a sheet of such reflective material is attached to or laminated to the inside face to such an end member, forming a layered structure therefor.

In another embodiment of the present invention, both end members comprise such a reflective face, and in particular a reflective non-breakable material for accomplishing the purposes of this invention. Preferably, certain plastic materials and the like are particularly preferred.

BRIEF DESCRIPTION OF THE DRAWINGS

The invention will be more clearly understood by reference to the description below taken in connection with the accompanying drawings wherein.

DETAILED DESCRIPTION

Figure 1:
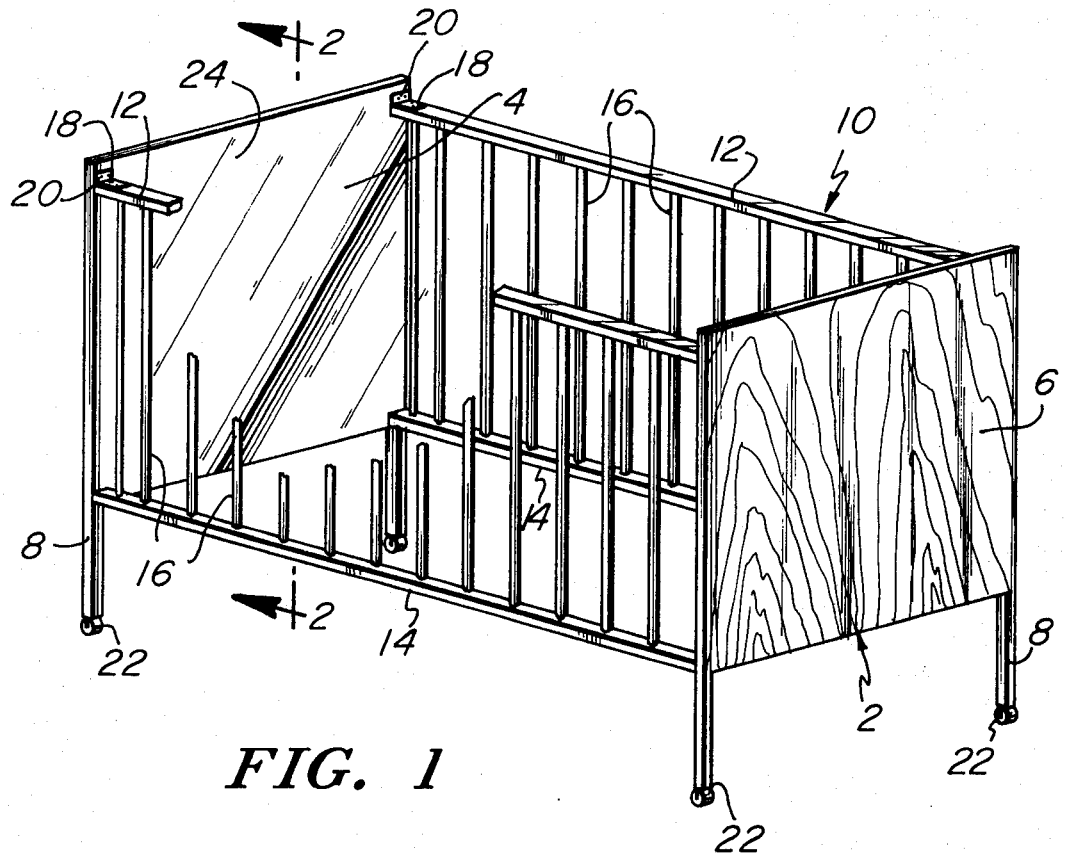
FIG. 1 shows an elevational front prospective view of the crib of the present invention.

Referring to the Figures, in which like numerals refer to like portions thereof, FIG. 1 shows a crib 2 in accordance with the present invention, including a pair of end boards, that is namely a headboard 4 and a footboard 6, each of which comprises a substantially square portion, including upstanding leg portions 8 extending therefrom.

The cribs also include a pair of side portions 10, generally rectangular in shape, and connecting the end portions 4 and 6, so as to form a rectangular enclosure therebetween. The side members 10 themselves include a pair of parallel top and bottom bar members 12 and 14, again extending from the headboard 4 to the footboard 6. These bar members are joined by parallel spaced rail members 16. The top and bottom bar members 12 and 14 may be connected to the end members by conventional means, such as a bracket 18, including screws 20 inserted both into the top of the rail member and the face of the end member as shown. The parallel spaced rail members 16 are connected to the parallel top and bottom bar members 12 and 14 by conventional means.

At the bottom of the side rail members 10, located at a height approximately even with the bottom rail member 14, means are generally provided for placement of a mattress, springs, etc., all of which is conventional, and is not shown in the drawings. In a preferred embodiment, each of the end members 4 and 6 includes casters 22 inserted at the bottom of the leg members 8, so that the crib itself can be easily moved from place to place by wheeling same.

Figure 2:
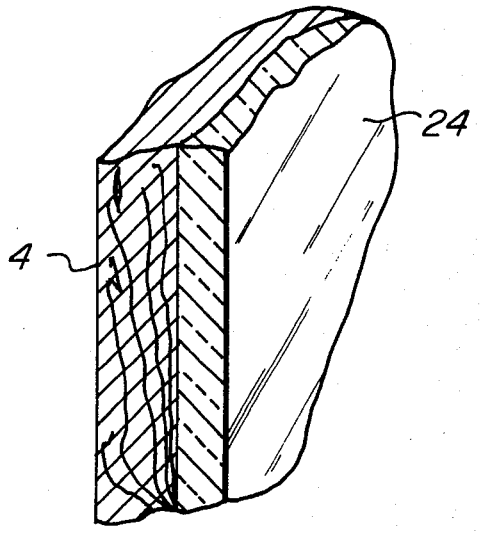
FIG. 2 shows a partial side cross-sectional view of a portion of one end board in accordance with the present invention, taken along lines 2—2 of FIG. 1.

The inner face of the headboard 4 shown in the drawing includes a reflective, preferably non-breakable surface. In the embodiment shown in FIG. 2, the reflective surface 24 is attached directly to the inner face of the headboard 4, such as by glue, use of screws, etc. In a preferred embodiment, however, as shown in FIG. 1, the entire headboard 4 is manufactured from a solid sheet of reflective material 24, and it is therefore unnecessary to apply that material to any wood or other surface comprising the headboard itself. In addition, it is also preferred to employ such a reflective material on the inner face of both the headboard 4 and the footboard 6, and most preferably actually manufacturing both the headboard and the footboard 4 and 6, respectively, from this reflective, non-breakable material. While these headboards and/or footboards may therefore be constructed from glass, preferably non-breakable, and most preferably mounted on a backing, such as a metal-plated glass, such as chrome-plated glass, it is most preferred to use a non-shattering material such as a reflective plastic, for safety purposes. Thus, a metal such as chrome-plated plastic would be particularly preferred. In this manner, a child within the crib enclosure will observe his own image upon the headboard, footboard, or both, and will remain amused or entertained for periods of time which would otherwise not occur.

As various possible embodiments might be made of the above invention and as various changes might be made in the embodiments set forth above, it is to be understood that all matters herein described or shown in the accompanying drawings are to be interpreted as illustrative and not in a limiting sense.

What is claimed is:

1. A crib comprising a pair of opposing end members and a pair of opposing side members attached to each of said end members, so that said end members and said side members form an enclosure, wherein at least one of said end members comprises a reflective face so that an infant within the said enclosure can observe his image upon said reflective face.

2. The crib of claim 1 wherein both of said pair of end members comprise a reflective face.

3. The crib of claim 1 wherein said reflective face comprises a non-breakable material.

4. The crib of claim 1 wherein said pair of side members include a plurality of spaced side rails thereon.

5. The crib of claim 1 wherein a separate reflective material is attached to the inner face of said end member opposing the other end member.

6. The crib of claim 5 wherein a reflective material is attached to both inner faces of said opposing end members.

7. The crib of claim 1 wherein each of said end members includes upstanding leg portions, and including casters attached thereto.

8. The crib of claim 1 wherein said reflective material comprises plastic.

* * * * *